United States Patent [19]

Gries

[11] 4,441,299

[45] Apr. 10, 1984

[54] METALLIC SECURITY BAR SYSTEM FOR WINDOW AND PATIO DOORS

[76] Inventor: Richard C. Gries, 37 Freedom Ct., Baltimore, Md. 21220

[21] Appl. No.: 343,487

[22] Filed: Jan. 28, 1982

[51] Int. Cl.[3] ..... E04H 3/08; E04C 3/30

[52] U.S. Cl. ..... 52/656; 52/106; 52/727

[58] Field of Search ..... 52/507, 106, 727, 807, 52/656; 292/137; 49/50, 141; 256/21, 22, 65, 59

[56] References Cited

U.S. PATENT DOCUMENTS

| | | | |
|---|---|---|---|
| 2,032,693 | 3/1936 | Fries | 52/106 X |
| 2,158,291 | 5/1939 | Lank | 52/727 |
| 2,668,729 | 2/1954 | Watters | 292/137 |
| 3,200,554 | 8/1965 | Goodman | 52/727 |
| 3,507,229 | 4/1970 | MacDonald | 52/106 X |

*Primary Examiner*—John E. Murtagh
*Assistant Examiner*—Kathryn L. Ford
*Attorney, Agent, or Firm*—John F. McClellan, Sr.

[57] ABSTRACT

An improved metallic security bar system of the type used for windows or patio doors, for improving appearance and feel and for retarding condensation and rust includes an easily installed wooden covering over the metal parts; channel-shaped wooden members are slid laterally on frame sides and tops and bottoms, and rod-holding bars, and covered with wood plates, and the rods are covered by tubular wooden members of sufficient cross-sectional size at the ends to conceal the rod-receiving slots.

1 Claim, 25 Drawing Figures

METALLIC SECURITY BAR SYSTEM FOR WINDOW AND PATIO DOORS

FIELD OF THE INVENTION

This invention relates generally to protective devices and specifically to improved interior window and door unauthorized-access-preventing security bars.

BACKGROUND OF THE INVENTION

Today, perhaps more than ever in the history of the United States, businessmen and householders are alike experiencing property loss, property destruction, fear of personal injury and person injury through unauthorized entry of intruders into buildings.

It is significant that at the same time, more types of protective bars and other barriers are conveniently available than ever before, but that people are reluctant to install them for fear of making their places of business and homes appear to have jail windows.

A good example of a window guard suitable for interior installation is shown in U.S. Pat. No. 2,668,729 issued to G. S. Watters, Mar. 11, 1950 for Securing Device. This guard has an array of spaced rods held by horizontal bars and has a hinged end rod of the array of rods at one side and an end rod of the array of rods that slides out when unlocked, or otherwise released to permit the unit to hinge open, at the other side.

Reasons why such security guards are not used may include that they give a threatened atmosphere to the space guarded, that they have a crude, cold appearance, that they are typically of steel installed at cold parts of spaces and "sweat" by moisture condensation from room air, and drip and rust, that they need frequent painting and are hard to paint, and that they don't match any interior decoration scheme of home or business.

Plastic encasement of parts of metal window units has been proposed but such does not impart the warmth of appearance and feel needed to disguise the true nature of barred provisions protecting windows and doors.

OBJECTS OF THE INVENTION

Objects, therefore, of the present invention are to provide a system with decorative and functional covering of window-and-door security bars of the straight-rod-and-bar type; to provide such system which is durable, economical, easy to install and efficient, which does not sweat or corrode, and which can blend in with almost any plan of interior decoration.

BRIEF SUMMARY OF THE INVENTION

In brief summary given as cursive description only and not as limitation the invention includes a system of covering security-bar systems of steel and the like with ornamental and protective wood and the like.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
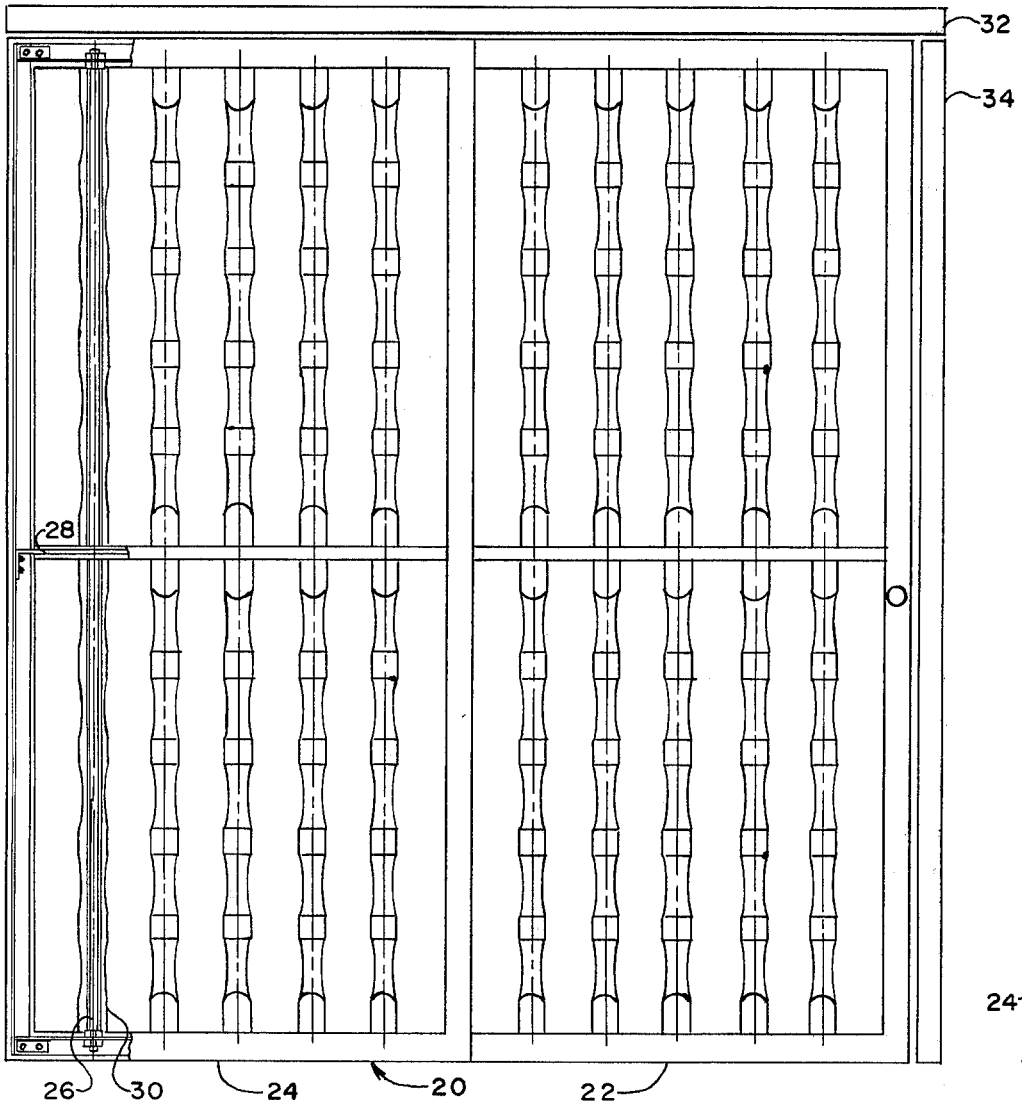
FIG. 1 is an elevational view of a patio door protected by security bars according to this invention.

FIG. 1 shows the appearance of a patio-door assembly 20 of fixed element 22 and movable element 24 embodying the invention.

This is a completely barred metal door but looks more like an ornamental room divider because the typical vertical rods 26 and horizontal bars 28 are completely concealed by a wood covering 30 which can be natural finish oak, birch, cherry, mahogany or the like.

The door is warm to the touch as well as inviting in appearance, and the metal parts are insulated by the wood against condensation which can cause rusting.

The conventional header 32 and jamb 34 may also be covered with wood if desired, matched by the doors.

Figure 2:
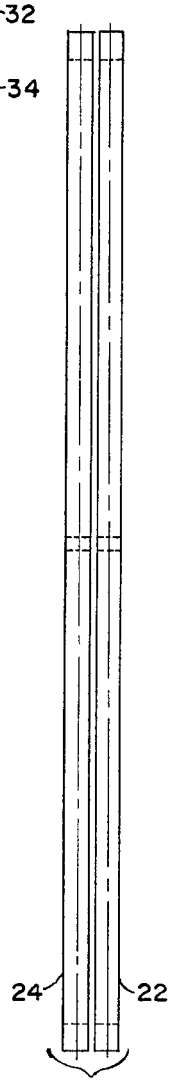
FIG. 2 is a side-elevational view thereof.
Figure 3:
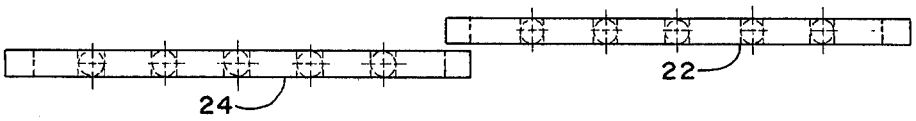
FIG. 3 is a top plan view thereof.

FIGS. 2 and 3 show that the door elements 22, 24 are conventional in dimensional detail except that they are slightly thicker, higher and wider than customary.

Figure 4:
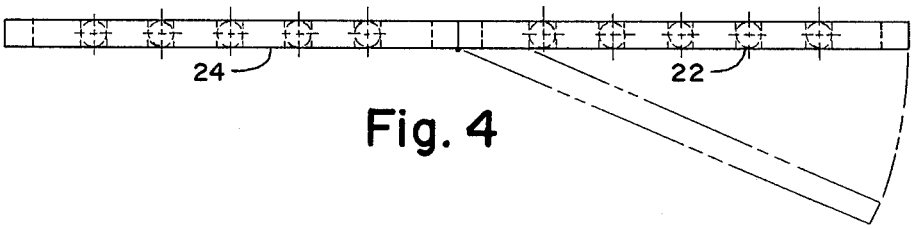
FIG. 4 is a top plan view indicating that the patio door assembly embodying the invention may be pivoted instead of sliding.

FIG. 4 indicates (broken lines) that instead of sliding, the movable part of the door, 24, may hinge open; the invention does not hinder this.

Figure 5:
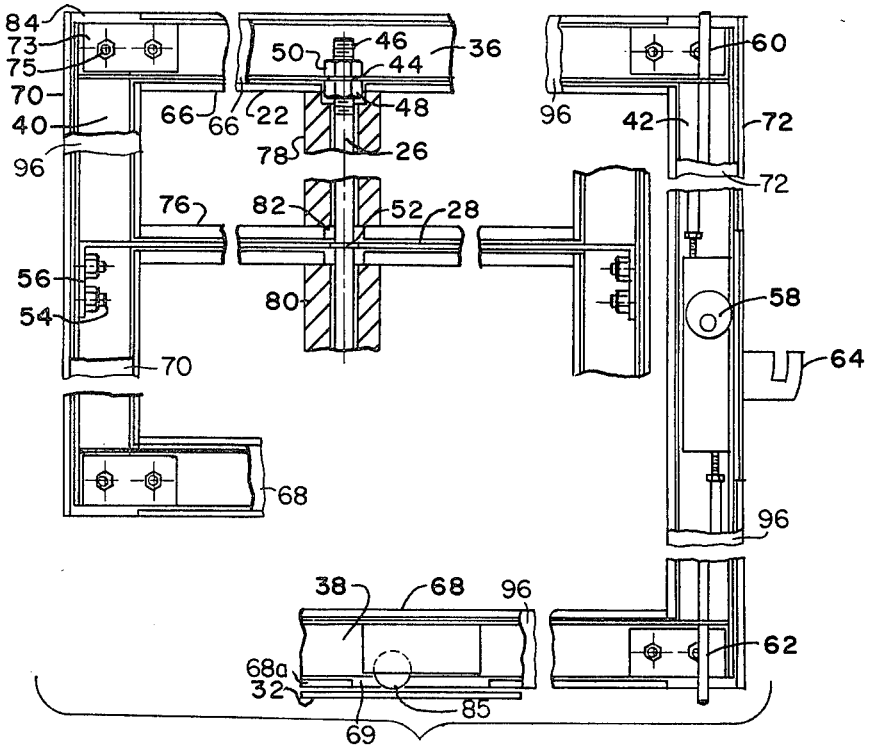
FIG. 5 is an enlarged-scale fragmentary, partially sectional, partially exploded view showing elevational details.

FIG. 5 indicates structural details and provision of a conventional locking means not hindered by the invention.

The metal elements of the door parts (22 shown reversed) are customary and include a horizontal frame member 36, 38 respectively at the top and at the bottom. These are joined together by a vertical frame member 40, 42 at the left and the right.

A plurality of vertical rods 26 are held in uniform horizontal spacing by retention in holes 44 in the upper and lower horizontal frame members.

Threaded ends 46 and inner and outer nuts 48, 50 may be used for the retention.

The vertical rods also pass through respective holes 52 in horizontal bar 28 which may be affixed across an intermediate portion of the door by bolts 54 in the turned end portions 56, or by welding.

A conventional lock system 58 may be provided such as a three-point deadlock No. MS1851-A sold by Adams Rite Manufacturing Company of 1425 Grand Central Avenue, Glendale, Calif. 91201. On key actuation a header bolt 60 and a threshold bolt 62 protrude at the bottom and top and a pivoted bolt 64 may protrude laterally, all engaging suitable strikes.

According to this invention, wood pieces are provided to cover this assembly in a manner simple enough to be understood and applied by the average householder, but completely and tightly.

Squared-"U" section (wood) channels 70, 72, 66, 68 with (wood) cover plates 96, which slide into place from one side of the door, are used except for the rods 26 which have (wood) rod covers 78 with respective axial holes through them through which the (metal) rods 26 insert. The (metal) top horizontal frame member 36 has wood cover 66 (see FIG. 11) and, the (metal) bottom horizontal frame member 38 has a corresponding wood cover 68 (these are respective second channel-section covers), the left vertical frame member has corresponding wood cover 70, the right vertical frame member has wood cover 72 (these are respective first channel-section covers). The rod-engaging bar 28 has corresponding wood cover 76 (third channel-section cover).

Each rod 26 has two tubular wood rod-covers 78, 80 on each rod, one above and one below bar 28 (illustrated also ing FIG. 6).

For assembly, the rod covers 78, 80 are put in place, the rods 26 being first thrust through horizontal rod-engaging has 28 which is then bolted at 54, 56; the inner nuts 48 are installed, the (metal) top horizontal frame member 36 and (metal) bottom horizontal frame member 38 are fixed in place by plates 73 and bolts 76 and the outer nuts 50 are installed loosely. All bolts may have flush heads.

Next, the (wood) horizontal bar cover 76 is slid into place between the ends of the upper and lower rod covers 78, 80 and with the rounded end slots 82 accepting the rods 26 above and below the bar 28.

Finally, the outer nuts are tightened, the lock is installed, and the cover plates 96, FIGS. 14 and 15 and 104, FIGS. 19 and 20 are screwed or cemented over the open sides of the respective squared "U"-section members 66, 68 and 70, 72. Access holes 84 may be provided; these may be covered with similar cover plates, also cemented in place. Numeral 85 designates a conventional roller assembly tracking on header 32, both conventional. An opening 69 is provided in the lower arm **68*a* of channel 68** for roller clearance.

Figure 6:
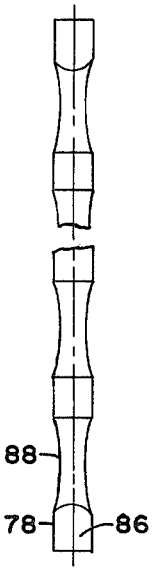
FIG. 6 and FIG. 7 are respectively elevational and end views of a rod cover.
Figure 7:
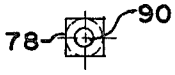

FIGS. 6 and 7 show a typical rod cover 78 which may have at the ends at least, and preferably at intermediate positions, square-section shapes 86. These may be separated by ornamental, concave lengths 88 with circular-section shape. Numeral 90 designates the hole for a rod.

Figure 8:
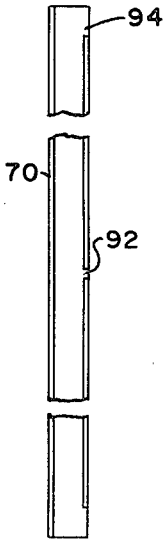
FIGS. 8, 9 and 10 show respectively two elevational aspects and an end view of a vertical frame cover channel.
Figure 9:
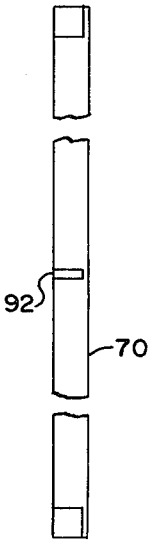
Figure 10:
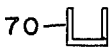

FIGS. 8, 9 and 10 show a channel-shaped vertical frame cover 70 with slot 92 for the horizontal bar and notches 94 for assembly to the corresponding horizontal covers. The right hand vertical frame cover is the same unit, inverted, for economy.

Figure 11:
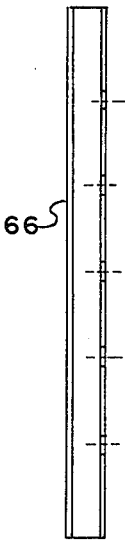
FIG. 11 is an elevational view of a horizontal frame cover channel.
Figure 12:
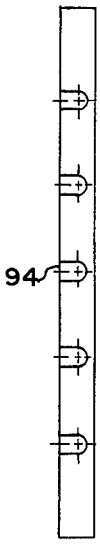
FIG. 12 is a plan view of the horizontal frame cover channel.
Figure 13:
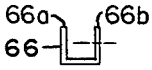
FIG. 13 is an end elevational view of the horizontal frame cover channel.

FIGS. 11, 12 and 13 show a horizontal frame member cover 66 which may be used both at top and bottom, for economy. Curved-end (round-end) slots 94 receive the rods through one leg of this channel **66*a* and 66*b*** are first and second legs.

Figures 14, 15:
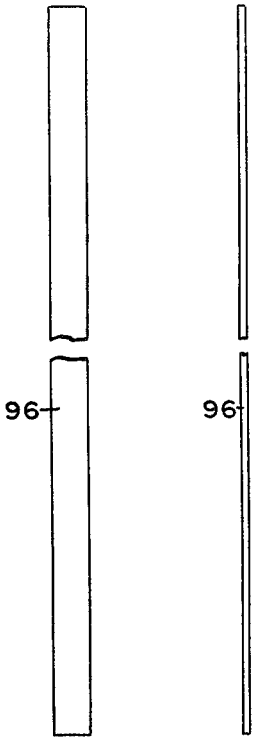
FIGS. 14 and 15 are face view and edge view respectively of a cover plate usable on the vertical frame cover channel or the horizontal frame cover channel, according to length employed.

FIGS. 14 and 15 show the planar cover plate 96 which can be used to cover the open face of the vertical frame member cover 70, 72 and the horizontal frame member covers 66, 68 (FIG. 5).

Figures 16, 17:
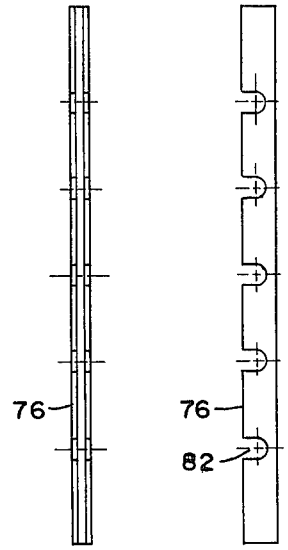
FIGS. 16, 17 and 18 are respectively face view, plan view and end view of a bar cover channel.
Figure 18:
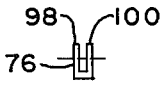

FIGS. 16, 17 and 18 show the horizontal bar cover 76, a channel similar to that of FIGS. 11–13 except that it is narrower between the legs 98, 100 to fit the horizontal bar 28 previously described, and it has aligned rod-receiving rounded-end slots 82 through both legs, one of which legs goes above and the other below the horizontal bar; rounded-end slots 82 are all the same shape and size.

Figures 19, 20:
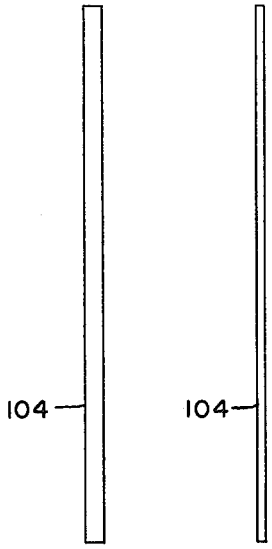
FIGS. 19 and 20 are respectively face view and edge view of a cover plate for the bar cover channel.

FIGS. 19 and 20 show the corresponding cover plate 104 ("third cover plate") for the bar cover 76.

All cover plates (for example 96 covering 70 and 104 covering 76) are applied on the ends of the channel legs, not inside the channels. Consequently the center of curvature of the rounded end of the rod-fitting slot is made closer to the open end of the channel so that it centers on the channel and cover plate as a unit. This permits the square-sections of the rod cover end to close and conceal completely the rod receiving slots.

Figures 21, 22, 23, 24:
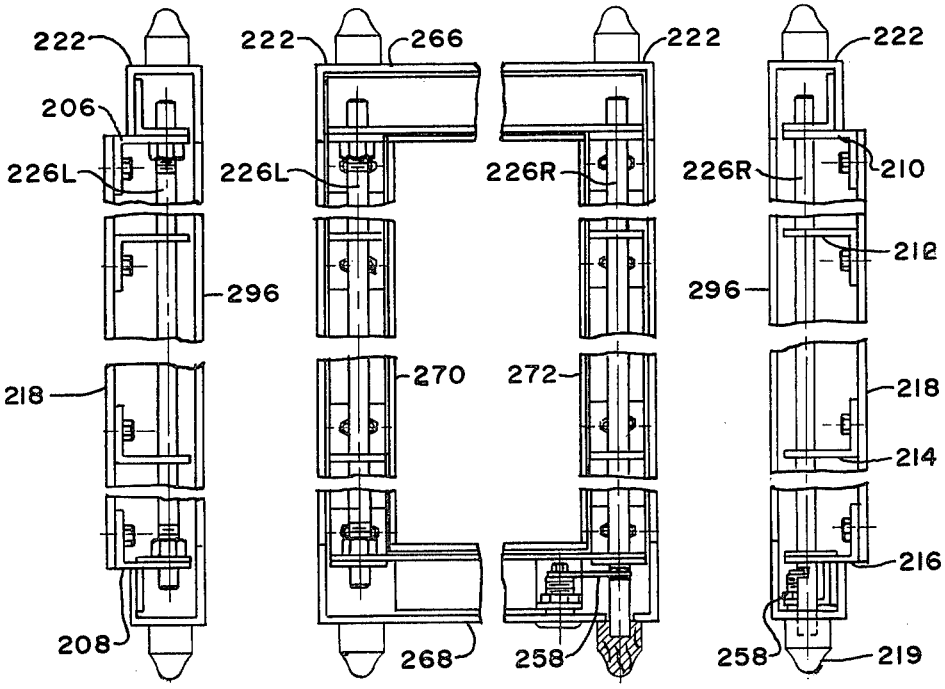
FIG. 21 is an enlarged-scale fragmentary end-elevational detail of an alternative embodiment of the invention.
FIG. 22 is a similar detail in face view of the FIG. 21 showing.
FIG. 23 is a similar detail to that of FIG. 22 but of an opposite side.
FIG. 24 is a view similar to that of FIG. 21 but of an opposite end.

FIGS. 21, 22, 23 and 24 show the invention embodied in a window security bar set 222. FIGS. 22 and 23 being face views of fragments, opposite sides, and FIGS. 21 and 24 being end details rotated 90° from the respective face views.

Construction is similar to that of the respective parts of the patio door assembly previously described, except that there may be no bar, and the left-most rod 226L pivots on brackets 206, 208, indicated, when the right-most rod 226R is released from notch-and-arm lock 258 and is slid axially down, free of holed angle-clips 210, 212, 214, 216. The building wall portion supporting the brackets angle-clips is indicated at 218.

Covers are indicated at 266, 268, 270, 272. These have corresponding cover-plate 296 and finials 219, one of which serves as a handle on the lower end of the removable rod 226R.

The necessary channel-shapes and recesses may be routed out of solid wood.

Figure 25:
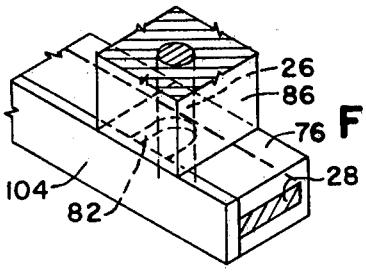
FIG. 25 is a perspective fragmentary view showing a detail of the first embodiment.

FIG. 25 shows in fragmentary detail square section shape 86 concealing a slot 82, in horizontal bar cover or squared "U"-section channel 76, through which slot rod 26 passes. Cover plate 104 closes the "U"-section channel, as described.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a metal security bar system of the type used as patio door, window and the like, with top (36) and bottom (38) horizontal frame members and first and second vertical side frame members (40, 42), a plurality of laterally-spaced vertical rods (26) held thereby, a plurality of tubular wooden covers (78, 80) over each said vertical rods (26); and a perforate horizontal bar (28) holding a middle portion of said plurality of laterally-spaced vertical rods (26), the improvement comprising: means for improving the appearance and feel of said metal security bar system and retarding condensation thereon including: a substantially complete wood cover over said security bar system, said wood cover including: a first channel section cover (70,72) over each of said vertical side frame members (40, 42), a second channel-section cover (66, 68) over each of said top and bottom horizontal frame members (36, 38) first and second cover plates (96) respectively on said first (70,72) and second (66,68) channel-section covers, each said second channel-section cover (66,68) having in section a first leg and a second leg, the structure of each second leg defining a plurality of slots (94) in said second leg for receiving said plurality of laterally-spaced vertical rods (26) respectively in said slots (94) in the second leg, a third channel-section cover (76) over said perforate horizontal bar (28), the third channel-section cover (76) having a plurality of aligned slots (82) therethrough for respectively receiving said plurality of laterally-spaced vertical rods (26), a third cover plate (104), said third cover plate (104) on said third channel-section cover (76), each said tubular wooden cover (78, 80) having respective square-section ends thereof abutting a second channel-section cover (66,68) at a said slot (94) in the second channel-section cover and abutting the third channel-section cover (76) at a said aligned slot (82) in the third channel-section cover (76), means providing for said respective ends of said tubular wooden covers to cover said slots (94) in said second channel-section covers (66,68) and said aligned slots 82 in said third channel-section cover, comprising said first and second (96) and third (104) cover plates being on respective outside parts of said first (70,72), second (66,68) and third (76) channel-section covers, and each of said plurality of slots (94) and plurality of aligned slots (82) having a rounded-end offset co-acting with said first (70,72), second (66,68) and third (76) channel section covers and completely covering said plurality of slots (94) and plurality of aligned slots (82).

* * * * *